US008447175B2

(12) United States Patent
Timm et al.

(10) Patent No.: US 8,447,175 B2
(45) **Date of Patent: *May 21, 2013**

(54) ENERGY DELIVERY SYSTEM FOR A GAS TRANSPORT VESSEL CONTAINING LOW VAPOR PRESSURE GAS

(75) Inventors: Martin Lee Timm, Getzville, NY (US); Thomas John Bergman, Jr., Clarence Center, NY (US); Justin Cole Germond, Amherst, NY (US); Keith Randall Pace, East Amherst, NY (US); Kenneth Leroy Burgers, East Amherst, NY (US); Michael Clinton Johnson, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 374 days.

This patent is subject to a terminal disclaimer.

(21) Appl. No.: 12/726,975

(22) Filed: Mar. 18, 2010

(65) Prior Publication Data

US 2010/0170268 A1 Jul. 8, 2010

Related U.S. Application Data

(63) Continuation of application No. 11/476,042, filed on Jun. 28, 2006, now Pat. No. 7,778,530.

(51) Int. Cl.
*F24H 7/00* (2006.01)

(52) U.S. Cl.
USPC ..... 392/342; 392/339; 392/346

(58) Field of Classification Search
USPC ..... 392/339–346
See application file for complete search history.

(56) References Cited

U.S. PATENT DOCUMENTS

| | | | | |
|---|---|---|---|---|
| 4,833,299 | A | 5/1989 | Estes | |
| 5,197,595 | A | 3/1993 | Coultas | |
| 6,025,576 | A | 2/2000 | Beck et al. | |
| 6,363,728 | B1 | 4/2002 | Udischas et al. | |
| 6,581,412 | B2 | 6/2003 | Pant et al. | |
| 6,614,009 | B2 | 9/2003 | Gershtein et al. | |
| 7,778,530 | B2 * | 8/2010 | Timm et al. | 392/342 |
| 2005/0132720 | A1 | 6/2005 | Rameau et al. | |

FOREIGN PATENT DOCUMENTS

| | | |
|---|---|---|
| AT | 360968 | 2/1981 |
| CN | 1532444 | 9/2004 |
| DE | 2636310 | 2/1978 |
| DE | 3530806 | 1/1987 |
| DE | 4031950 | 5/1991 |

(Continued)

*Primary Examiner* — Thor Campbell
(74) *Attorney, Agent, or Firm* — Nilay S. Dalal

(57) ABSTRACT

A system for delivering vapor phase fluid at an elevated pressure from a transport vessel containing liquefied or two-phase fluid is provided. The system includes: (a) a transport vessel positioned in a substantially horizontal position; (b) one or more energy delivery elements disposed on the lower portion of the transport vessel wherein the energy delivery devices include a heating means and a first insulation means, wherein the energy delivery devices are configured to the contour of the transport vessel; (c) one or more substantially rigid support devices disposed on the outer periphery of the energy delivery devices, wherein the support devices hold the energy delivery devices in thermal contact with a lower portion of the transport vessel; and (d) one or more attaching devices secure the rigid support devices onto the transport vessel and hold the energy delivery devices between the substantially rigid support device and a wall of the transport vessel.

15 Claims, 5 Drawing Sheets

FOREIGN PATENT DOCUMENTS

| | | |
|---|---|---|
| DE | 4320759 | 1/1995 |
| EP | 0052351 | 5/1982 |
| EP | 0844431 A2 | 5/1998 |
| JP | 2005214306 | 8/2005 |

* cited by examiner

ENERGY DELIVERY SYSTEM FOR A GAS TRANSPORT VESSEL CONTAINING LOW VAPOR PRESSURE GAS

CROSS-REFERENCE TO RELATED APPLICATION

The present application is a continuation of U.S. patent application Ser. No. 11/476,042, filed Jun. 28, 2006 now U.S. Pat. No. 7,778,530, the entire contents of which are incorporated herein by reference in its entirety.

BACKGROUND OF THE INVENTION

1. Field of the Invention

The present invention relates to an efficient energy delivery system which can be employed with any number of large scale transport vessels to deliver fluid to a semiconductor, light emitting diode or liquid crystal display manufacturer. In particular, the energy delivery system is removable from the transport vessel, yet maintains the integrity necessary to deliver energy to the vessel in an efficient manner.

2. Description of Related Art

Industrial processing and manufacturing applications such as semiconductor, light emitting diode (LED), liquid crystal display (LCD) manufacture require processing steps which employ one or more non-air fluids. It will be understood by those skilled in the art that "non-air" fluids or gases refer to fluids (in various phases) which are not derived from the constituent components of air. As utilized herein, non-air fluids or gases include, but are not limited to, ammonia, boron trichloride, carbon dioxide, chlorine, dichlorosilane, halocarbons, etc. Specifically, the manufacture requires the application of non-air gases in vapor phase.

Generally, gases are delivered to the manufacturer's facility in a transport vessel, which is utilized as part of the delivery mechanism. Fluid is removed from this vessel in vapor phase and delivered to the point-of-use in a discontinuous manner.

The ultimate application requires that the vapor phase gas contain a relatively low level of low volatility contaminants, as otherwise these contaminants can deposit on the product substrate (e.g., semiconductor wafer, LCD motherglass or LED sapphire base). Deposition of these low volatility contaminants, which include water, metal and particulates, can produce a number of deleterious effects, including reduced brightness (LED manufacture) and yield loss (semiconductor, LCD, or LED manufacture).

Fluids such as silane and nitrogen trifluoride are delivered and stored in vapor phase. Since low volatility components do not evaporate readily, their concentration in these fluids is typically low. Other non-air fluids or gases are transported and stored as liquids or vapor/liquid mixtures. These gases are commonly known as low vapor pressure gases, and include, for example, ammonia, hydrogen chloride, carbon dioxide, and dichlorosilane. These fluids typically have a vapor pressure of less than 1,500 psig at a temperature of 70° F. A complex mechanism is necessary to deliver these latter gases to the point-of-use in vapor phase at the requisite purity, since the conversion of stored liquid low vapor pressure gases into vapor tends to cause the low volatility contaminants to vaporize.

Some systems convert stored liquid low vapor pressure gases into vapor by withdrawing liquid from the transport vessel and partially vaporizing same in a separate vessel. These systems generate a contaminant-enriched liquid waste which must be transferred for disposal. Further, they require a mechanism for transferring liquid from the transport vessel to the vaporization vessel, necessitating a pump or an inert gas pressurization mechanism.

Other systems are designed to vaporize liquid phase low vapor pressure gas in the transport vessel. In small scale systems, this vaporization means may be readily transferred from one vessel to another as the liquid content is exhausted. However, in larger supply systems, such as ISO container based systems, it is difficult to transfer the vaporization means from one transport vessel to another because the heaters and their attachment mechanism are cumbersome. Further, these heaters often do not conform well to large vessels, resulting in poor heat transfer, high heat losses, heater burn out and the formation of "hot spots" on the transport vessel. "Hot spots" are a potential safety issue, since transport vessels are typically not designed for high temperature.

Another significant drawback to these systems is that they can cause vigorous liquid phase low vapor pressure gas boiling. Such boiling can cause liquid droplets containing low volatility contaminants to be entrained and carried into the vapor phase.

In light of the numerous issues associated with the production and delivery of vapor phase low vapor pressure fluid from either a liquid or two-phase non-air fluid, a number of proposals for low vapor pressure fluid vaporization have been made in the related art.

One such proposal has been provided in U.S. Pat. Nos. 4,833,299 and 5,197,595. The apparatus described in these patents consist of flexible heaters, insulation, a fabric such as a flexible heater/insulation unit, and a releasable means for securing opposite ends of the housing unit to the vessel. The apparatus described by these documents, however, are small vertical cylinders, where the heaters wrap around the entire vessel circumference.

U.S. Pat. No. 6,025,576 discloses a heated transport vessel for low vapor pressure gases withdrawn therefrom. The heaters are in tensioned contact with the transport vessel. One of the disadvantages with such a system is that heaters could sag, bulge or otherwise wrinkle and lose the contact with the vessel wall. As a result, the energy transfer to the vessel is not uniform or efficient.

U.S. Pat. No. 6,614,009 relates to a supply of ultra high purity gases in large volumes and high flow rates from a container of liquefied gas. The heaters are permanently positioned onto the container. Therefore devices simply cannot be removed and attached to another vessel.

U.S. Pat. No. 6,363,728 discusses a system for controlled delivery of a gas from a liquefied state where the heat exchangers are in contact with the transport vessel. The heat exchangers are either of the type where the liquid transfer media is circulated through a metallic coil or alternatively an electric heater embedded in a metallic coil. However, these systems do not evenly distribute energy, nor do they conform to the contour of the vessel.

U.S. Pat. No. 6,581,412 likewise discusses a system for controlled delivery of a gas from a liquefied state where the heat exchangers are in contact with the transport vessel. The heat exchangers described are heating jackets and hot water or oil baths. Oil baths are impractical for large scale systems. As described in this patent, heating jackets are designed for higher temperature to compensate for a poor contact between the heaters and the vessel. Moreover, the frequent changes of the compressed gas vessel, which is inevitable at high flow rates, reduces the contact effectiveness.

Some of the disadvantages related to the systems of the latter described documents are that they result in poor energy transfer and premature heater and vessel failure. Specifically, the heating devices are not readily usable on various transport/storage vessels, and lack the requisite efficiency to deliver the vapor phase fluid at a high flow rate while maintaining the purity required at the point-of-use.

To overcome the disadvantages of the related art, it is an object of the present invention to provide an uncomplicated system for the delivery of a vapor phase non-air gas from a liquefied compressed gas cylinder to a point-of-use.

It is another object of the invention, to provide a system for delivering vapor phase fluid at an elevated pressure from the transport/storage vessel, where the energy delivery devices are configured and held in contact with the vessel wall so as to efficiently deliver energy to the vessel. In particular, the heating means are held in close contact with the wall of the transport/storage vessel, and substantially eliminates the uneven distribution of energy.

It is yet another object of the invention, to provide an energy delivery system that is adapted to be removed and utilized on various transport/storage vessels. Moreover, the energy delivery devices of this system can readily be removed and replaced in the event of failure.

Other objects and aspects of the present invention will become apparent to one of ordinary skill in the art upon review of the specification, drawings and claims appended hereto.

SUMMARY OF THE INVENTION

According to an aspect of the invention, a system for delivering vapor phase fluid at an elevated pressure from a transport vessel containing liquefied or two-phase fluid is provided. The system includes (a) a transport vessel positioned in a substantially horizontal position; (b) one or more energy delivery devices disposed on the lower portion of the transport vessel wherein the energy delivery devices include a heating means and a first insulation means, wherein the energy delivery elements are configured to the contour of the transport vessel; (c) one or more substantially rigid support devices disposed on the outer periphery of the energy delivery devices, wherein the support devices hold the energy delivery devices in thermal contact with a lower portion of the transport vessel; and (d) one or more attaching devices to secure the rigid support devices onto the transport vessel and hold the energy delivery devices between the substantially rigid support device and a wall of the transport vessel.

In accordance with another aspect of the invention, an efficient energy delivery system adapted to various cylindrical vessels is provided. The system includes (a) a crescent-shaped substantially rigid cradle to accommodate a horizontally placed cylindrical vessel; (b) a heater element disposed between the cradle and the wall of the cylindrical vessel, wherein the heater element has substantially the same configuration as the cradle; and (c) a first insulation layer disposed between the cradle and the heater element to minimize the heat lost in a direction away from the cylindrical vessel, wherein elements (a)-(c) constitutes an energy delivery system adapted to be employed with various cylindrical vessels.

BRIEF DESCRIPTION OF THE FIGURES

The objects and advantages of the invention will be better understood from the following detailed description of the preferred embodiments thereof in connection with the accompanying figures wherein like numbers denote same features throughout and wherein.

DETAILED DESCRIPTION OF THE INVENTION

The manufacture of semiconductor devices, LEDs, LCDs and solar/photovoltaic cells requires the delivery of vapor phase, low vapor pressure gases to a point-of-use. These fluids must meet customer purity and flow requirements. The present invention provides a means to transport a compressed, liquefied low vapor pressure gas from the gas manufacturer, and process this non-air fluid so as to deliver a low vapor pressure vapor stream which is lean in low volatility contaminants to the point-of-use. As utilized herein, the term "lean" shall mean a vapor stream having a lower level of low volatility contaminants therein than the liquid or two-phase fluid provided by the gas manufacturer. The system provides the requisite purity on a consistent basis. Further, the transport/storage vessel (referred below, as the transport vessel) is preferably designed to carry more than about 2,000 lbs. and preferably between 20,000 and 50,000 lbs. of low vapor pressure fluid. Additionally, it is preferable that the vessel be capable of being shipped, and is compliant with International Standards Organization (ISO) requirements (e.g., ISO container standards).

Typically, low vapor pressure non-air fluids are stored in a transport vessel under their own vapor pressure. While the fluid contained in the transport vessel delivered to the point-of-use is process dependent, for ease of reference ammonia is utilized as the fluid of choice, but it will be understood that any number of low vapor pressure non-air fluids may be utilized. The transport vessel can be constructed from a material such as carbon steel, type 304 and 316 stainless steel, Hastelloy, nickel or a coated metal (e.g., a zirconium-coated carbon) which is strictly non-reactive with the fluids utilized and can withstand both a vacuum and high pressures.

The transport vessel, such as an ISO container, is installed "on-site," that is in close proximity to the manufacturing facility and may be installed outdoor, where the temperature can be as low as −30° C., or indoor. The manufacturing facility is preferably equipped with automatic gas sensors and an emergency abatement system in case of an accidental leakage or other malfunctions of the system.

Figure 1:
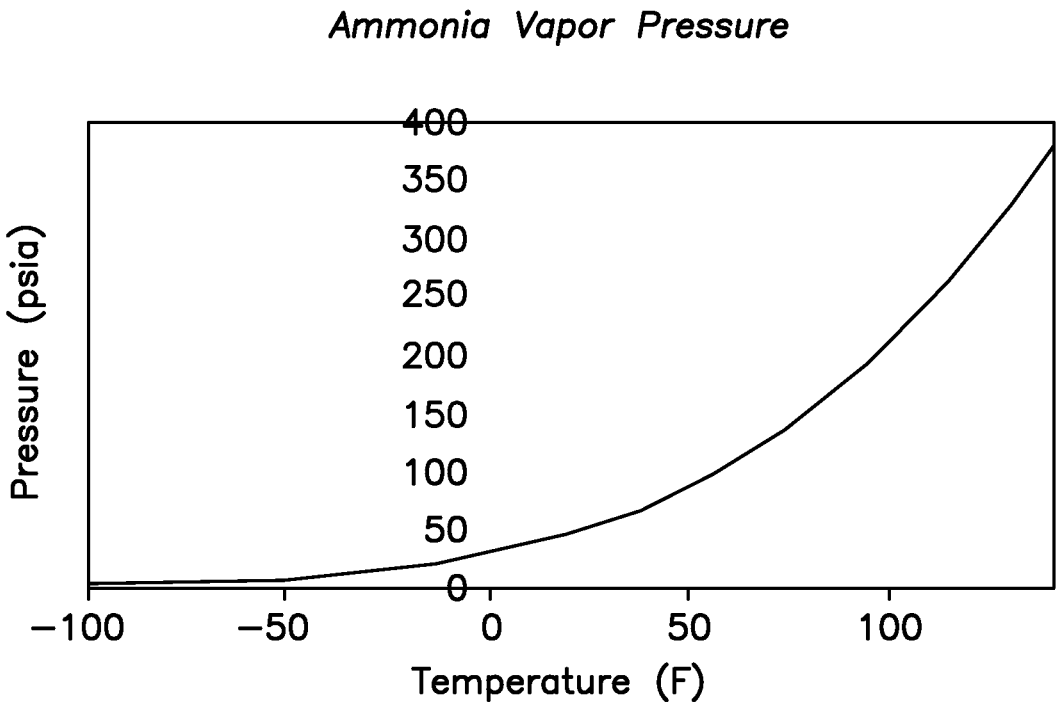
FIG. 1 is a graphical illustration of ammonia vapor pressure.

The transport vessel is not typically insulated. As a result, the temperature of the transport vessel contents during transport and storage at the facility is similar to ambient temperature. With reference to FIG. 1, the pressure in the transport vessel is dictated by the vapor pressure of ammonia at the temperature of the transport vessel contents. As indicated graphically, at a temperature of 50° F., the pressure in the transport vessel is approximately 89.2 psia.

Most manufacturing facilities require ammonia delivery pressures in excess of 100 psig. To meet these pressure requirements, the temperature of the transport vessel contents must be elevated by applying heat from a heat source.

Figure 2:
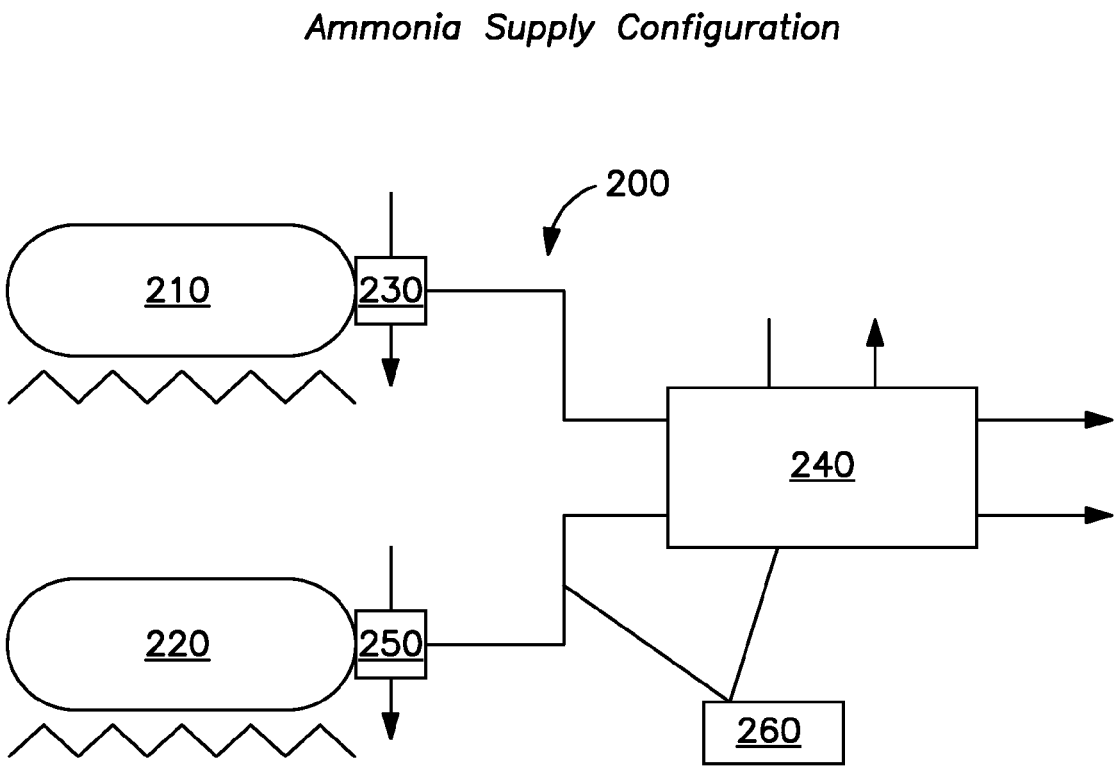
FIG. 2 illustrates an exemplary embodiment of a system for delivering vapor phase fluid at an elevated pressure, where the system has two ISO containers positioned in parallel.

In one exemplary embodiment of the invention, and as illustrated in FIG. 2, an ammonia supply system 200 is provided. Two transport vessels or ISO containers 210, 220 are installed in parallel and placed in a substantially horizontal position at the manufacturer's facility.

While initially a liquid-vapor phase equilibrium is maintained in ISO container 210, this equilibrium is upset when the manufacturing facility begins to withdraw vapor phase ammonia. In operation, ammonia fluid in vapor phase is withdrawn from either ISO container 210 or 220 at flow rates ranging from about 0 to 10,000 standard liters per minute (slpm), preferably from about 0 to 7,500 slpm, and most preferably from about 0 to 3,500 slpm. As the manufacturing facility draws vapor phase ammonia, the amount of vapor phase ammonia in the ISO container decreases. This causes the vessel pressure to fall. To return the ISO container pressure to its initial level, some of the liquid phase ammonia must be vaporized to replace the vapor mass that was withdrawn.

Figure 3:
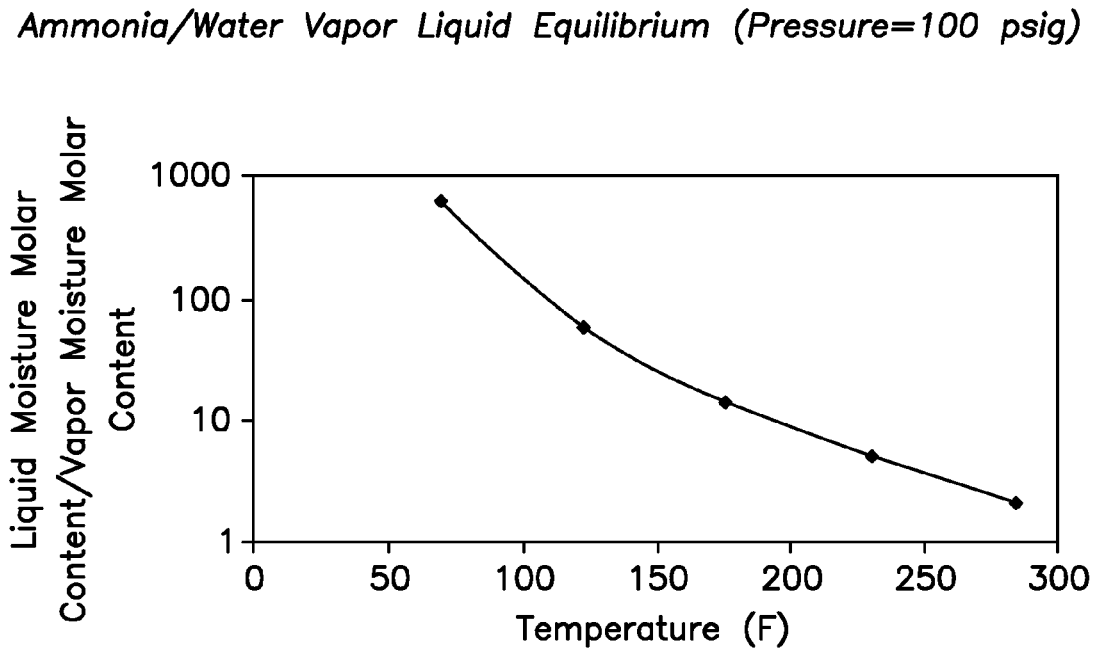
FIG. 3; is a graphical illustration of the moisture distribution between the vapor and liquid phases in ammonia.

Ammonia in the ISO container typically has some contaminant level. Some of these contaminants, for example water, are less volatile than ammonia. Therefore, their concentration in the liquid phase is higher than their concentration in the vapor phase. For example, and with reference to FIG. 3, when vapor phase ammonia is in equilibrium with liquid phase ammonia at 70° F., the concentration of water in the liquid phase is approximately 800 times the concentration in the vapor phase. As a result, the concentration of these low volatility contaminants will rise as the ammonia contents are consumed since moisture will build in the liquid phase. If the ammonia is completely consumed, the moisture level in the vapor phase would increase to an unacceptable level (typically, <1 ppm is unacceptable). To prevent this phenomenon from occurring, some of the liquid ammonia is typically left behind as low volatility contaminant enriched waste (also known as "the heel"). The waste liquid volume is between 1% and 50%, preferably between 5% and 30% and most preferably between 10% and 20% of the initial liquid volume.

As vapor is withdrawn from ISO container 210, it passes through containment device 230 which is typically purged with nitrogen. The containment device contains valves, fittings, etc., that have the potential to leak. Vapor phase ammonia is conveyed from containment device 230 to a source gas panel 240, which regulates the flow rate of ammonia to the point-of-use.

As demonstrated previously, the pressure within the ISO container 210 falls as vapor ammonia is withdrawn. This causes the temperature of the remaining fluid in the container to likewise fall, as shown in FIG. 1.

In order to maintain the ISO container temperature and pressure, energy in the form of heat must be transferred to the ISO container contents. The amount of energy required to sustain the ISO container pressure and temperature at given flow rate must be considered, as well as potential heat losses. For example, to sustain a vapor flow rate of 3,500 slpm at 70° F., the heat transfer to ISO container 210 is on the order of 50 to 60 kW, assuming no heat losses. As explained in U.S. Pat. No. 6,363,728 which is incorporated herein by reference in its entirety, the rate of heat transfer between the heating means and ISO container 210 is governed by: (1) the overall heat transfer coefficient; (2) the surface area available for heat transfer; and (3) the temperature difference between the heaters and the contents of ISO container 210.

The source of energy is one or more energy delivery devices disposed on the lower portion of the ISO container. The energy delivery devices are typically electrical resistance type heating means/elements typically selected from blanket heaters, heating bars, cables and coils, band heaters, heater tape and heating wires. Alternative heating elements include intermediate fluid based heaters and inductive heaters.

Intermediate fluid based heaters transfer heat to an intermediate fluid, such as water, which then transfers heat to the transport vessel and ultimately to the low vapor pressure fluid. The intermediate fluid may transfer heat to the transport vessel by a number of mechanisms, such as by passing the intermediate fluid through heating coils. Inductive heaters generate a magnetic field, which is then used to generate heat. This heat could then be passed to a device such as a band or coil which is in contact with the transport vessel.

In the exemplified embodiment, vapor phase ammonia is withdrawn from ISO container 210 at a variable rate. To maintain the ISO container pressure in response to this variable rate, a pressure controller is used, which regulates the energy input to ISO container 210. Delivery system 200 includes a closed-loop control means to monitor the pressure at which the ammonia vapor withdrawn and to compensate for the energy of vaporization utilized to deliver the ammonia vapor at a desired flow rate. Suitable control means 260 are known in the art, and include, for example, a programmable logic controller (PLC) or microprocessor (not shown).

In the exemplified embodiment, a pressure sensor (not shown) sends a measurement signal to the PLC thereby indicating the pressure of the vapor phase ammonia delivered to the source gas panel 240. The measured pressure is compared to a pressure set point. Should the pressure decrease below the expected pressure, a signal is transmitted from the PLC to the energy delivery device to deliver energy to ISO container 210. Thus, the thermal energy is employed to restore the pressure necessary to maintain demanded flow rate of vapor delivered to the point-of-use. In the event the level of ammonia fluid in ISO container 210 should drop to below the level at which the desired flow rate can be sustained as determined by the PLC, system 200 would switch to ISO container 220 so as to deliver the vapor to containment device 250, and in turn to source gas panel 250, which regulates the flow rate of ammonia to the point-of-use, as discussed with respect to ISO container 210. It will be understood that heater controls need to include a mechanism to prevent the heating means from overheating if the pressure loss becomes excessive.

Alternatively, an algorithm could be employed to determine the transport vessel 210 surface temperature required to sustain the set point pressure in conjunction with a pressure vs. temperature curve for the ammonia system employed. Upon deriving the required transport vessel surface temperature, its value is compared with a surface temperature set point range. In the event that the temperature falls below the lower limit of the range, energy in the form of heat is applied. Conversely, if the temperature is above the range, energy is removed.

Returning to the energy delivery device, these devices are not only positioned at the lower portion of the vessel, but are configured to the contour of the vessel to efficiently transfer energy/heat to the vessel. Although the heating means/elements discussed above are adequate means for providing energy to the system, in some instances they do not conform well to the contour of the vessel or are otherwise difficult to hold in close proximity or contact with the wall of the transport vessel. As a result, at the contact points between the transport vessel and the heating means/elements can become very hot and exceed the transport vessel's design temperature. Liquid ammonia contained near these "hot spots" can boil vigorously, causing liquid droplets containing high-low volatility contaminant levels to be carried over into the vapor stream. As a result, the low-volatility contaminant level may exceed acceptable limits.

Away from the contact points, energy will not transfer efficiently from the heating means/elements to the vessel surface, resulting in increased heat losses and excessive power consumption. Further, the heating means are susceptible to overheating and burn out at those locations for which contact between the heating means/elements and the transport vessel is poor.

Figure 4:
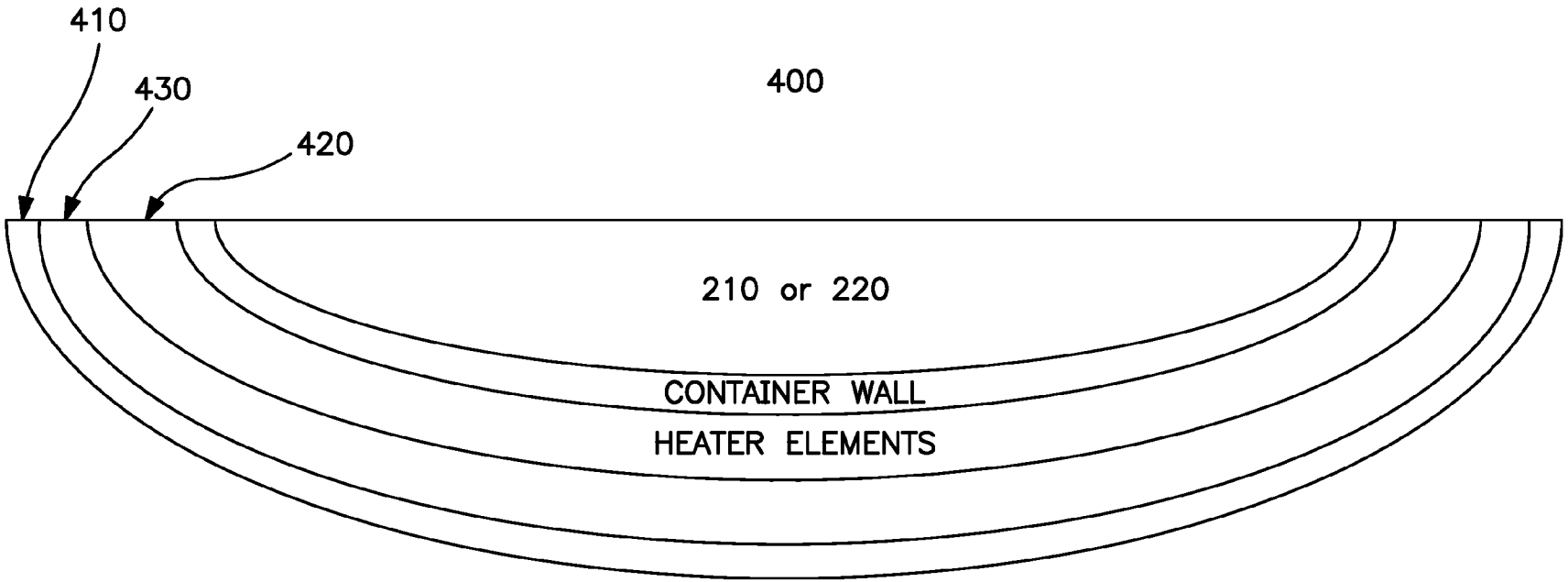
FIG. 4 illustrates an exemplary embodiment of the energy delivery device, in accordance with the present invention.

To ensure uniform, intimate contact between the energy delivery devices and the transport vessel, an efficient energy delivery system 400 was developed, as depicted in FIG. 4. The system includes a crescent-shaped substantially rigid cradle 410 which accommodates horizontally placed transport vessels, such as ISO containers 210 and 220. Heating elements 420 and insulation 430 are disposed between cradle 410 and the wall of the transport vessel. Heating elements 420 are placed in cradle 410 such that intimate, uniform contact is achieved with the transport vessel. Heater types which are pliable and conform well to the shape of the transport vessel, such as silicone rubber blanket heaters, are most preferred. In addition, the energy delivery device may include copper grounding plates.

The insulation 430 is placed between the cradle and the heating elements such that heat is directed from the heating elements 420 to the transport vessel, thereby minimizing heat losses. The insulation is preferably pliable and conforms well to the shape of the transport vessel. One such type of insulation is silicone rubber sheet insulation.

The cradle can be made of any substantially rigid material, including but not limited to stainless steel, such that it supports and maintains the heating means in close proximity with the lower portion of vessel which cradle 410 encompasses, so that it does not sag, bulge, wrinkle or otherwise lose contact with the wall of the vessel.

Insulation 430 is preferably attached to the cradle using an adhesive, which is not depicted. Further, the heater elements are preferably attached to the insulation using a second adhesive layer, which is also not depicted. Because the heating elements and insulation are adhered to the cradle, the opportunity for heater warping or bulging is eliminated.

Figure 5:
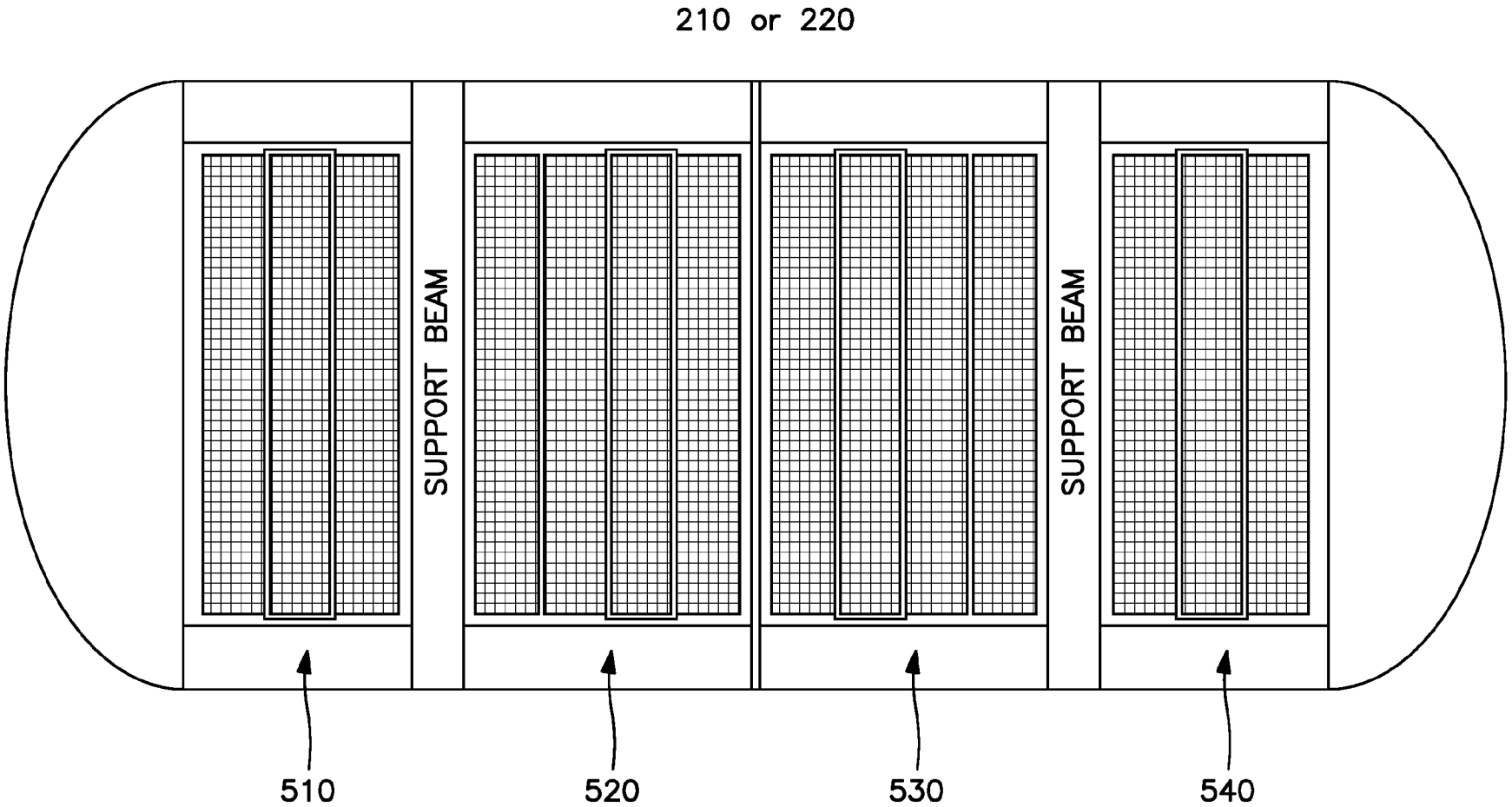
FIG. 5 illustrates various energy delivery devices split into various heating zones on an ISO container.

With reference to FIG. 5, the energy delivery devices can be split into various heating zones 510, 520, 530 and 540, encompassing a different portion of the horizontally placed ISO container 210. Each one of these zones is monitored and controlled by a PLC type of device to provide energy in the manner described above.

Each of the substantially rigid support devices (i.e., crescent-shaped cradles) is attached to the ISO container, preferably using straps or springs attached to both ends of the support devices and which wrap around the top of the container where they are connected by buckles. Alternatively, the straps or springs may attach to fixed objects located on the upper portion of the ISO container, such as the sun shield support brackets. By attaching the cradle to the transport vessel in this manner, the heating elements are compressed between the cradle and the transport vessel, ensuring intimate contact. This eliminates the possibility of heater buckling or sagging.

Using this attachment method, the support devices are easily removed and employed with other transport vessels. Therefore, a specific transport vessel does not need to be dedicated to each manufacturing facility, nor does a transport vessel have to be purchased for use at a given manufacturing facility (transport vessels may be leased from any supplier and remain compatible with the heating equipment).

Because it is large, it is likely that the ISO container will be located outdoor at the manufacturing facility. Typically, it is desirable to maintain the pressure within the ISO container at a level of at least 100 psig, implying that the temperature within the ISO container is approximately 70° F. If ambient temperature is less than this value, heat losses will be experienced from the ISO container itself to ambient. To minimize these losses, it may be desirable to surround the ISO container with a second insulation means. The second insulation means is preferably easily transferred from vessel to vessel. For example, the second insulation means may be an insulating tarp that is draped over the ISO container or the ISO container frame. This insulating tarp may be constructed of one of many insulating materials, such as foam insulations.

While the invention has been described in detail with reference to exemplary embodiments thereof, it will become apparent to one skilled in the art that various changes and modifications can be made, and equivalents employed, without departing from the scope of the appended claims.

What is claimed is:

1. A system for delivering vapor phase fluid at an elevated pressure from a transport vessel containing liquefied or two-phase fluid, comprising:

(a) a transport vessel positioned in a substantially horizontal position;

(b) one or more removable energy delivery elements disposed on the lower portion of the transport vessel wherein the energy delivery devices include a heating means and a first insulation means, wherein the energy delivery devices are configured to the contour of the transport vessel;

(c) one or more substantially rigid support devices disposed on the outer periphery of the energy delivery devices, wherein the support devices are in the form of stainless steel cradles holding the energy delivery devices in thermal contact with a lower portion of the transport vessel; and (d) one or more attaching devices secure the rigid support devices onto the transport vessel and hold the energy delivery devices between the substantially rigid support device and a wall of the transport vessel.

2. The energy delivery systems of claim 1, wherein the transport vessel is an ISO container vessel.

3. The energy delivery system of claim 1, wherein the fluid transported, stored and delivered is a non-air based gas selected from the group consisting of ammonia, boron trichloride, carbon dioxide, chlorine, dichlorosilane, halocarbons, hydrogen bromide, hydrogen chloride, hydrogen fluoride, methylsilane, nitrous oxide, trichlorosilane and mixtures thereof.

4. The energy delivery system of claim 1, wherein the first insulation means is a medium density sponge insulation disposed between an outer surface of the heating means and the substantially rigid support device.

5. The energy delivery system of claim 1, wherein the energy delivery element is flexible or rigid.

6. The energy delivery system of claim 1, wherein the support device is adapted to be employed with any number of transport vessels.

7. The energy delivery system of claim 1, wherein the attaching devices are selected from the group consisting of springs and straps which attach at an upper part of the vessel.

8. The energy delivery system of claim 1, further comprising a control means to deliver the non-air based gas vapor at a desired flow rate.

9. The energy delivery system of claim 1, wherein the point-of-use is a semiconductor, liquid crystal display or light emitting diode manufacturer.

10. The energy delivery system of claim 1, wherein a second insulation means is applied to the transport vessel.

11. An efficient energy delivery system adapted to various cylindrical vessels, comprising:

(a) a crescent-shaped substantially rigid cradle made from stainless steel configured to accommodate a horizontally placed cylindrical vessel;

(b) a removable heater element disposed between the cradle and the wall of the cylindrical vessel, wherein the heater element has substantially the same configuration as the cradle; and (c) a first insulation layer disposed between the cradle and the heater element to minimize the heat lost in a direction away from the cylindrical vessel, wherein elements (a)-(c) constitutes an energy delivery system adapted to be employed with various cylindrical vessels.

12. The efficient delivery system of claim 11, wherein the heater element comprises a silicone rubber heating layer disposed between the cradle and the cylinder.

13. The efficient delivery system of claim 11, wherein the first insulation layer is a medium density sponge.

14. The efficient delivery system of claim 11, wherein the crescent-shaped substantially rigid cradle accommodates a lower portion of the cylindrical vessel when the cylindrical vessel is placed in a horizontal position.

15. The efficient delivery system of claim 11, wherein the cylindrical vessel is an ISO container.

* * * * *